US005934356A

United States Patent [19]

Di Paolo et al.

[11] Patent Number: 5,934,356

[45] Date of Patent: Aug. 10, 1999

[54] COMPACT CONTINUOUS CASTING LINE

[75] Inventors: Carlo Di Paolo, Campoformido; Estore Donini, Vimercate; Fausto Drigani, Zugliano-Pozzuolo del Friuli, all of Italy

[73] Assignee: Danieli & Co. Officine Meccaniche SpA, Ruttrio, Italy

[21] Appl. No.: 08/987,020

[22] Filed: Dec. 9, 1997

[30] Foreign Application Priority Data

Dec. 9, 1996 [IT] Italy ..... UD96A0234

[51] Int. Cl.[6] ..... B22D 11/12; B22D 11/10

[52] U.S. Cl. ..... 164/263; 164/417; 164/426

[58] Field of Search ..... 164/263, 460, 164/417, 476, 477, 426, 446; 29/527.7

[56] References Cited

U.S. PATENT DOCUMENTS

| | | | |
|---|---|---|---|
| 5,065,811 | 11/1991 | Scholz et al. | 164/263 |
| 5,193,606 | 3/1993 | Behrends | 164/426 |
| 5,528,816 | 6/1996 | Donini et al. | 164/476 |
| 5,810,069 | 9/1998 | Flick et al. | 164/477 |
| 5,832,985 | 11/1998 | Pleschiutschnigg et al. | 164/477 |

FOREIGN PATENT DOCUMENTS

| | | |
|---|---|---|
| 586823 | 3/1994 | European Pat. Off. . |
| 9200815 | 1/1992 | WIPO . |

*Primary Examiner*—Harold Pyon
*Assistant Examiner*—I.-H. Lin
*Attorney, Agent, or Firm*—Antonelli, Terry, Stout & Kraus, LLP

[57] ABSTRACT

Compact continuous casting line for thin slabs, the continuous casting line comprising at least a curved segment and a subsequent straight segment, the casting line comprising at least an ingot mould (12) connected at the outlet with an extraction and possible soft reduction assembly (13) associated at the end with at least a drawing assembly (14) consisting of pinch rolls (15), the drawing assembly (14) being followed by at least a shearing assembly (16), an extractor device (17) to extract the dummy bar and by a possible temperature-restoration furnace (21, 121), there also being included at least a descaling device (20) using water, the descaling device (20) being arranged upstream of the shearing assembly (16), and the temperature-restoration furnace (21, 121) being arranged in a position near the outlet of the shearing assembly (16).

11 Claims, 2 Drawing Sheets

COMPACT CONTINUOUS CASTING LINE

BACKGROUND OF THE INVENTION

This invention concerns a compact continuous casting line for the production of thin slabs.

The invention is applied both in casting lines at least partially curved which include, at the outlet of the ingot mould, a straight and vertical solidification area followed by the straightening of an already solidified product, and also to casting lines which include a solidification area at least partially curved, where the straightening can be performed on a product which has not yet completely solidified.

Furthermore, the invention is applied also to casting lines where at least the end segment of the ingot mould is curved in a coherent manner with the curve of the casting line.

The possible furnace to restore the temperature of the product, which is associated with the casting line according to the invention, can be of the tunnel type placed in line with the casting machine and the shearing assembly, or it may be of the type including an inlet and outlet rollerway, and the transverse travel of the segments of thin slab.

The state of the art covers continuous casting plants which comprise at least an ingot mould associated at the lower part with an assembly to extract and straighten the thin slab.

According to whether the area of solidification for the slab emerging from the ingot mould is straight or partly curved, the extraction and straightening assembly acts on a product which is either completely solidified or has only the skin solidified and the core still liquid.

The extraction and straightening assembly is normally associated at the end with one or more, generally two, pinch roll assemblies, followed downstream by a shearing assembly able to shear the slab into single segments which are then rolled or possibly discarded.

In continuous casting lines, at present the segments of slab thus formed are subjected to a descaling operation, normally performed by a rotary device placed between the shearing assembly and the temperature-restoration furnace, if any, placed upstream of the rolling train.

The function of the descaling device upstream of the temperature-restoration furnace is to eliminate the scale which has formed during the casting process, and also any casting powders on the surface of the slab.

This descaling action prevents any hard and resistant scale from forming as the segments of slab pass through the temperature-restoration furnace. It also prevents the formation of compounds of scale and powder, which are difficult to eliminate later, even by an intense descaling action performed at the outlet of the furnace.

Moreover, by performing the descaling action upstream of the temperature-restoration furnace it is possible to obtain on the surface of the slab a residual layer of scale of a uniform thickness and composition which is more easily removed by the normal descaling means placed downstream of the furnace and upstream of the rolling train.

The rotary descaling device normally comprises a plurality of nozzles, advantageously also rotary, which deliver water under high pressure onto the faces of the segments as they pass through.

One problem caused by the presence of this descaling assembly is that this water delivered by the nozzles flows over the upper surface of the segment of slab being descaled, even for long sections and both upstream and downstream of the descaling zone.

The flow of this descaling water causes considerable problems such as the unhomogeneous cooling of the slab, and therefore areas of excessive cooling are created. Moreover, the flow of water causes operational problems and possible damage to the equipment placed upstream and downstream of the descaling device.

To be more exact, if the tunnel furnace is placed in line with the casting machine and the shearing assembly, the entry of water inside the furnace is extremely dangerous, since the creation of steam inside the tunnel can seriously damage the furnace itself.

In order to obviate this problem, at present a pair of rolls are included, and are arranged upstream and downstream of the descaling device and in contact with the upper face of the segment; these rolls are. suitable to confine the water in the descaling zone, and prevent it from flowing outside the said area.

However, the proximity of the descaling device to the furnace, particularly in the case of a tunnel furnace, does not eliminate the risk that, in the event of a malfunction or if the retaining rolls are worn, some water may in any case enter inside the furnace and cause the serious problems mentioned above.

Another problem to be found in these casting lines is that the length of the line itself is increased by the inclusion of the descaling device and the pair of retaining rolls.

It is well-known in the field that even a limited reduction in the spaces occupied by the lines, and a shortening of the machine, is important in economic terms, given the considerable investment required by this type of line.

In plants known to the state of the art, the inclusion of the descaling device causes a lengthening of the line and also causes the temperature-restoration furnace to be farther from the shearing assembly. The greater distance of the furnace from the shearing assembly causes the segment of slab to lose a high level of heat, due to irradiance.

The reduction in the temperature of the segments as they enter the furnace involves a necessary increase in the furnace's capacity to re-heat the segments to the desired rolling temperature.

This increase, however, cannot be pushed beyond certain limits, otherwise it could cause a considerable loss of efficiency, excessive fuel consumption and a reduction in the working life of at least some of the components of the furnace, particularly the rolls.

If the rolls are water cooled, the increase in temperature inside the furnace, to compensate for the heat losses from irradiance, makes it necessary to increase the intensity of cooling, with a consequent increase in consumption and in operating costs.

A reduction in the temperature of the segments of slabs at the inlet to the furnace involves an increase in heating times, which can lead to the necessity of increasing the size of the furnace itself. This causes a further increase in the overall length of the plant, with an increase in the costs of all the structures and the connected plant, for example the sheds, the foundations, the pipes etc.

The line is also further lengthened because it is impossible to bring the descaling device nearer the shearing assembly because of the presence of the device to extract the dummy bar.

This extractor device normally consists of a slide connected to the shearing assembly; it includes a first position for the recovery of the dummy bar where it is in an oblique position at the outlet of the shearing assembly, and a second inoperative position where it is raised and substantially parallel to the rolling line.

The position assumed by the extractor device when it recovers the dummy bar therefore makes it necesary to distance the descaling device from the shearing assembly so as to avoid contact between the descaling device and the extractor device.

This causes a greater bulk in the casting line, a further distancing of the furnace and therefore a great effect on the overall costs.

SUMMARY OF THE INVENTION

The present applicants have designed, tested and embodied this invention to overcome the shortcomings of the state of the art, and to provide further advantages.

The purpose of the invention is to provide a casting line for thin slabs which makes it possible to obtain a reduction in the overall length, which gives a saving in the set-up costs without compromising the efficiency of the line.

A further purpose is to bring the temperature-restoration furnace, if any, nearer the shearing assembly, which reduces the loss of heat of the thin slabs caused by irradiance.

Another purpose of the invention is to distance the descaling device from the temperature-restoration furnace, if any, thus reducing the risk of water penetrating inside the furnace itself.

The casting line according to the invention comprises at least an ingot mould cooperating at the outlet with an extraction and possible soft reduction assembly, associated at the end with one or more pinch roll assemblies.

Downstream of the pinch roll assembly there is the shearing assembly, possibly followed by the tunnel-type temperature-restoration furnace.

According to a variant, the shearing assembly is followed by a rollerway to introduce the slabs into a temperature-restoration furnace where the slabs are transferred transversely by means of movable hearths or trolleys.

In one embodiment of the invention, upstream of the pinch roll assemblies there is a straightening assembly.

The straightening assembly, in a first solution, is powered.

According to a variant, the straightening assembly is not powered.

According to the invention, the descaling device is placed upstream of the shearing assembly and acts on the continuous slab emerging from the extraction and possible soft reduction assembly.

This position of the descaling device makes it possible to place the temperature-restoration furnace considerably nearer the outlet of the shearing assembly, by at least a distance equal to the bulk of the descaling device and the water-retaining rolls associated thereto.

By placing the temperature-restoration furnace nearer the shearing assembly the casting line is made considerably more compact and therefore enormous savings are obtained on the overall costs. Moreover, the temperature loss suffered by the segments of slab due to irradiance is reduced, and therefore the segments are introduced into the furnace at a higher temperature.

This means that the furnace itself does not need to supply the same heating capacity, which leads to a consequent reduction in fuel consumption, greater efficiency, less wear on the components, less need to cool the rolls, and possibly even a reduction in the dimensions of the furnaces.

Moreover, some functional components of the casting line may be eliminated, or at least reduced in number, such as for example, the systems to guide and support the slabs; this gives further savings in the set-up stage, and also during maintenance, of the line itself.

Moreover, distancing the descaling device from the furnace reduces the risk of the rolls not retaining the water, for example because of malfunctioning or wear, and therefore of the water entering inside the furnace.

According to a variant, the descaling device is located upstream of the shearing assembly in cooperation with the rolls of the drawing assemblies placed at the outlet of the extraction and soft reduction assembly.

In this embodiment, it is the pinch rolls of the drawing assembly which retain the descaling water and thus prevent the water from flowing along the slab as it passes through.

In this way it is possible to avoid using auxiliary rolls to contain the descaling water, and thus the arrangement of the line is simplified and costs are farther reduced.

In one embodiment of the invention,-the descaling device is of the type which includes nozzles mounted on rotary arms, such as for example those described in the American patent US-A-5,388,602 in the name of the Applicant.

According to a variant, the descaling device is of the type with nozzles mounted on arms which translate in a line from one end of the slab as it passes through to the other, such as for example that described in the Italian patent IT-A-1.259.782 in the name of the Applicant.

According to a further embodiment, the head of the nozzle support associated with the end of the arms, whether they be of the rotary type or movable in a line, is also rotary.

BRIEF DESCRIPTION OF THE DRAWINGS

The attached figures are given as a non-restrictive example and show two preferred embodiments of the invention as follows.

DETAILED DESCRIPTION OF THE PREFERRED EMBODIMENTS

Figure 3:
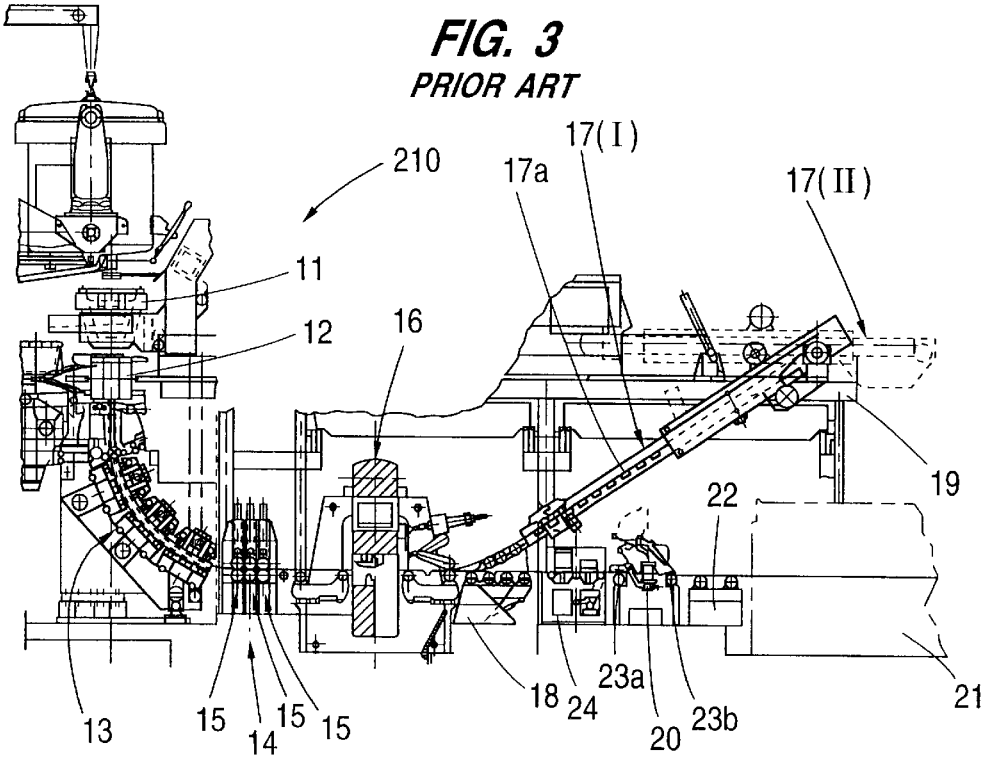
FIG. 3 PRIOR ART
FIG. 3 shows a continuous casting line according to the state of the art.

In the attached figures, the reference number 10 denotes generally a first embodiment of a continuous casting line according to the invention (FIG. 1), while the reference number 110 denotes another embodiment according to the invention (FIG. 2); the reference number 210 denotes a continuous casting line of the state of the art (FIG. 3).

The casting lines 10, 110, 210 comprise an ingot mould 12, associated with a tundish 11, downstream of which there is an extraction and possible soft reduction assembly 13.

The slab, associated at the leading end with the dummy bar, leaves the ingot mould 12, passes through the extraction and possible soft reduction assembly 13 where it undergoes a first reduction in thickness and from which it is progressively taken to a horizontal plane; a drawing assembly 14, consisting of pairs of pinch rolls 15, carries the slab forwards towards the shearing assembly 16.

In this case, upstream of the drawing assembly 14 there is a straightening assembly 25, consisting of an empowered straightener or, in a variant, a stationary segment which functions as a straightener.

The shearing assembly 16, in this case of the pendular shears type, shears the segments of slab to be sent for rolling.

The shearing assembly 16 may also have the function of shearing the slab into segments for scrap, for example when there are problems of quality, or in the event of temporary blockages in the line downstream.

At the outlet of the shearing assembly 16 the dummy bar is recovered by means of the dummy bar extractor device 17.

This extractor device 17, which is constrained hanging from a bridge structure 19, may have a first position (I) where it is inclined so as to recover the dummy bar, and a second, inoperative position (II) where it is substantially horizontal and parallel to the casting line.

When the extractor device 17 is in its inoperative position (II), it is possible to intervene on the leading end of the dummy bar.

In this case, the extractor device 17 cooperates with a sliding surface 18 which has a first position where the segments of slab emerging from the shearing assembly 16 are able to advance, and a second, oblique position where the dummy bar is diverted towards the slide 17*a* of the extractor device 17.

Figure 1:
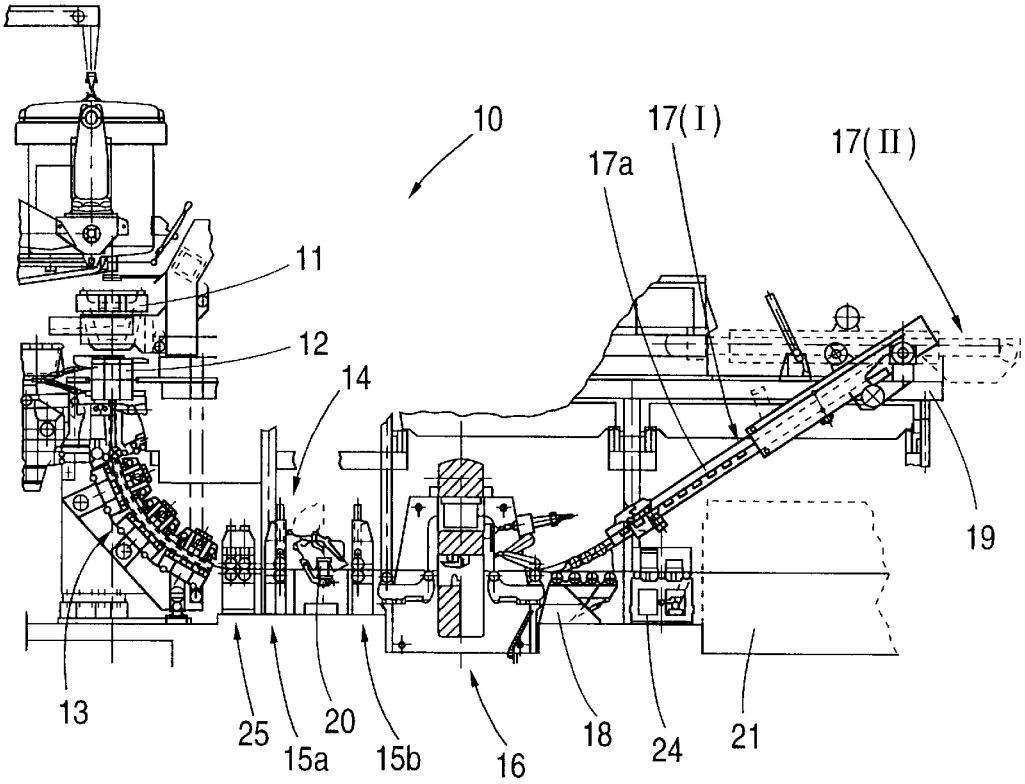
FIG. 1 shows a side view of a first possible lay-out of a compact continuous casting line according to the invention.

In the embodiment shown in FIGS. 1 and 3, downstream of the extractor device 17 there is an induction heating assembly 24.

In the state of the art embodiment shown in FIG. 3, downstream of the induction heating assembly 24 there is a descaling device 20, positioned at an appropriate distance from the shearing assembly 16 so as not to interfere with the extractor device 17.

The descaling device 20 is equipped with nozzles which deliver water at high pressure, and is associated with a pair of rolls to contain the water 23*a*, 23*b*, placed respectively upstream and downstream of the descaling device 20.

In one embodiment of the invention, the descaling device 20 is of the type with rotary arms and rotary nozzles.

According to a variant, the descaling device 20 is of the type with rotary arms and stationary nozzles.

According to another variant, the descaling device 20 is of the type with arms movable in a line, with rotary or stationary nozzles.

After descaling, the segments of slab are sent to the temperature-restoration furnace 21 by means of appropriate supporting and guiding means 22, and thence are sent for rolling.

In the casting line 10 according to the invention as shown in FIG. 1, the descaling device 20 is positioned in cooperation with the drawing assembly 14 and upstream of the shearing assembly 16.

By positioning the descaling device 20 upstream of the shearing assembly 16, it is possible to bring the temperature-restoration furnace 21 very near the outlet of the shearing assembly 16, which gives a considerably more compact line 10.

Moreover, the segments of slab lose considerably less heat due to irradiance in the portion of line between the shearing assembly 16 and the temperature-restoration furnace 21 because the furnace 21 is located immediately at the outlet of the shearing assembly 16.

Furthermore, the supporting and guiding means 22 placed between the shearing assembly 16 and the temperaturerestoration furnace 21 can be eliminated or at least reduced.

The temperature-restoration furnace 21 can be brought as close as possible to the extractor device 17 without actually coming into contact with the said extractor device 17.

In this case, the descaling device 20 is located, upstream of the shearing assembly 16, between the two pairs of rolls 15*a*, 15*b* which constitute the drawing assembly 14. These pairs of rolls 15*a*, 15*b* have the function of preventing the water from flowing along the slab as it passes through.

This greatly simplifies the arrangement of the descaling device 20 and gives a further reduction in the set-up costs and maintenance costs of the casting line 10 in its entirety, and also a reduction in its length.

Figure 2:
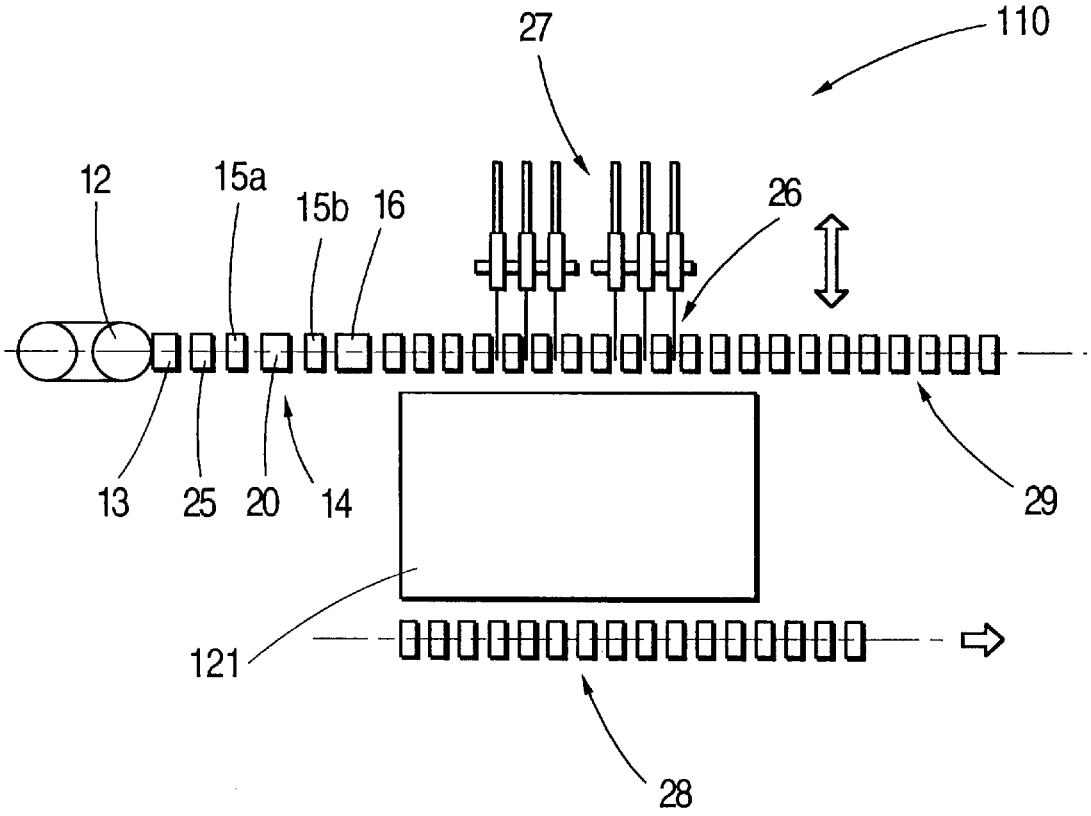
FIG. 2 shows a view from above of a second possible lay-out of a compact continuous casting line according to the invention.

The lay-out shown in FIG. 2 includes, downstream of the shearing assembly 16, an inlet rollerway 26 cooperating with a machine 27 to introduce the segments of slab into the furnace 121.

The furnace 121 is of the type which includes the transverse translation of the segments of slab, the translation being performed in a manner known to the state of the art, for example by step-by step movable hearths or by trolleys.

The segments of slab, after the temperature has been restored in the furnace 121, are discharged onto an outlet rollerway 28 on which they are then fed to the rolling train.

The inlet rollerway 26 may also be used, in cooperation with a discharge rollerway 29, to temporarily discharge the slabs arriving from the casting machine, or to load cool slabs arriving from a stock of cool products into the furnace 121.

We claim:

1. Compact continuous casting line for thin slabs, the continuous casting line including at least a curved section with a following straight section, the casting line comprising at least an ingot mould connected at the outlet with an extraction and possible soft reduction assembly associated at the end with at least a drawing assembly comprising two pairs of pinch rolls, the pinch roll drawing assembly being followed by at least a shearing assembly, a device to extract the dummy bar, and at least a descaling device using water, the line being characterised in that the descaling device is placed upstream of the shearing device and between the two pairs of pinch rolls.

2. Continuous casting line as in claim 1, in which the descaling device is of the type with rotary arms.

3. Continuous casting line as in claim 1, in which the descaling device is of the type with arms movable in a line.

4. Continuous casting line as in claim 1, in which the descaling device is of the type with rotary nozzles.

5. Continuous casting line as in claim 1, in which the descaling device is of the type with stationary nozzles.

6. Continuous casting line as in claim 1, in which upstream of the drawing assembly there is a straightening assembly (25).

7. Continuous casting line as in claim 6, in which the straightening assembly is empowered.

8. Continuous casting line as in claim 6, in which the straightening assembly is not empowered.

9. Continuous casting line as in claim 1, further comprising a temperature-restoration furnace provided near an outlet of the shearing assembly.

10. Continuous casting line as in claim 9, in which the temperature-restoration furnace is of the tunnel type and is placed substantially in line with the shearing assembly.

11. Continuous casting line as in claim 9, in which the temperature-restoration furnace is of the type whereby segments of thin slab emerging from the shearing assembly are transferred transversely.

* * * * *